US010035149B2

(12) United States Patent
Hiramura et al.

(10) Patent No.: US 10,035,149 B2
(45) Date of Patent: Jul. 31, 2018

(54) MIXING CONTAINER USED FOR REAGENTS

(71) Applicants: ARKRAY, Inc., Kyoto (JP); BODITECH MED INC., Gang-won-do (KR)

(72) Inventors: Fumito Hiramura, Kyoto (JP); Hironori Hasegawa, Kyoto (JP); Park Ki Tae, Chuncheon-si (KR); Kim Cheol Min, Chuncheon-si (KR)

(73) Assignees: ARKRAY, Inc., Kyoto (JP); BODITECH MED INC., Gang-won-do (KR)

( * ) Notice: Subject to any disclaimer, the term of this patent is extended or adjusted under 35 U.S.C. 154(b) by 3 days.

(21) Appl. No.: 14/967,788

(22) Filed: Dec. 14, 2015

(65) Prior Publication Data

US 2016/0175841 A1 Jun. 23, 2016

(30) Foreign Application Priority Data

Dec. 17, 2014 (JP) ..... 2014-255152

(51) Int. Cl.
*B01L 3/00* (2006.01)
*B01F 15/02* (2006.01)

(52) U.S. Cl.
CPC ..... *B01L 3/527* (2013.01); *B01F 15/0212* (2013.01); *B01F 15/0225* (2013.01);
(Continued)

(58) Field of Classification Search
CPC ..... B01L 3/527
(Continued)

(56) References Cited

U.S. PATENT DOCUMENTS 4,859,603 A * 8/1989 Dole ..... B01L 3/502 222/83
6,656,428 B1 * 12/2003 Clark ..... B01L 3/502 422/404
(Continued)

FOREIGN PATENT DOCUMENTS

JP H08-091418 A 4/1996
WO 2005/049207 A1 6/2005
(Continued)

OTHER PUBLICATIONS

ImmunoFineTM Strep A, 6 pages, Apr. 2011.
(Continued)

*Primary Examiner* — Jill A Warden
*Assistant Examiner* — Jacqueline Brazin
(74) *Attorney, Agent, or Firm* — Studebaker & Brackett PC

(57) ABSTRACT

A mixing container includes a first container that stores two or more reagents and a second container for mixing two or more reagents. The first container includes reagent storage chambers that are respectively provided for the two or more reagents and have openings formed at portions thereof, and a sealing member that seals the respective openings of the reagent storage chambers. The second container includes an opening portion formed such that the first container can be connected thereto, and protruding portions disposed so as to pierce the sealing member when the first container is connected to the opening portion.

6 Claims, 6 Drawing Sheets

(52) U.S. Cl.
CPC ..... *B01L 3/502* (2013.01); *B01L 2200/025* (2013.01); *B01L 2200/0689* (2013.01); *B01L 2300/044* (2013.01); *B01L 2300/046* (2013.01); *B01L 2300/047* (2013.01); *B01L 2300/0672* (2013.01)

(58) Field of Classification Search
USPC ..... 422/559
See application file for complete search history.

(56) References Cited

U.S. PATENT DOCUMENTS

2004/0200742 A1* 10/2004 Cho ..... B65D 51/2835 206/219
2009/0084792 A1* 4/2009 Mu-Yuan ..... B65D 47/061 220/361
2013/0224089 A1* 8/2013 Tanaka ..... B01L 3/508 422/559

FOREIGN PATENT DOCUMENTS

WO 2006/048866 A1 5/2006
WO 2010/020043 A1 2/2010

OTHER PUBLICATIONS

The extended European search report issued by the European Patent Office dated May 10, 2016, which corresponds to European Patent Application No. 15196473.1-1703 and is related to U.S. Appl. No. 14/967,788.
Communication pursuant to Article 94(3) EPC issued by the European Patent Office dated Jun. 16, 2017, which corresponds to European Patent Application No. 15 196 473.1-1703 and is related to U.S. Appl. No. 14/967,788.

* cited by examiner

MIXING CONTAINER USED FOR REAGENTS

CROSS-REFERENCE TO RELATED APPLICATION

This application is based upon and claims the benefit of priority from Japanese patent application No. 2014-255152, filed on Dec. 17, 2014, the disclosure of which are incorporated herein in its entirety by reference.

BACKGROUND OF THE INVENTION

1. Field of the Invention

The present invention relates to a mixing container for mixing two or more reagents.

2. Description of Related Art

Conventionally, when testing a specific sample, there are cases where preparation is needed in which two or more liquid or solid reagents are mixed immediately before use. Also, examples of samples include bodily fluids such as pharyngeal mucus, nasal cavity mucus, and blood. Also, when performing this kind of test, a special container is used in order to make it easier to mix the two or more reagents (e.g., see JP H8-91418A (Patent Document 1) and "ImmunoFine™ Strep A", [online], April 2011, Nichirei Biosciences Inc., (searched on Oct. 14, 2014), Internet <URL: http://www.nichirei.co.jp/bio/products/pd/522071_2.pdf> (Non-Patent Document 1)).

Specifically, Patent Document 1 and Non-Patent Document 1 disclose mixing containers provided with a tubular first container containing a first reagent and a second container containing a second reagent. Also, with both mixing containers, the second container is fit onto an opening of the first container.

Out of these, with the mixing container disclosed in Patent Document 1, the second container is fit onto the first container with a screw structure, and furthermore includes a tubular storage tube filled with the second reagent. Also, the mixing container disclosed in Patent Document 1 is configured such that when the second container is raised while being rotated, the bottom of the storage tube comes off and the second reagent falls below. For this reason, in the case of using the mixing container disclosed in Patent Document 1, the user can easily mix the reagents by merely rotating the second container.

Also, with the mixing container disclosed in Non-Patent Document 1, the second container is formed in a tube shape that can be fit inside of the first container. Furthermore, the bottom portion of the second container is also formed such that it is easily broken upon being pressed with a cotton swab on which a sample has been collected. Accordingly, in the case of using the mixing container disclosed in Non-Patent Document 1, the user can easily mix the reagents by merely inserting a cotton swab on which a sample has been collected into the second container and in that state, pressing it in.

SUMMARY OF THE INVENTION

However, the mixing container disclosed in Patent Document 1 is problematic in its construction, in that it is difficult to remove the lid of the storage tube if the force with which it is rotated is weak. It is also problematic in that a user usually needs to perform tasks while wearing gloves, and the task of rotating the second container while wearing gloves is not easy.

Furthermore, the mixing container disclosed in Non-Patent Document 1 is problematic in that the bottom of the second container needs to be broken with the cotton swab, and this task is not necessarily a task that is easy for everyone. It is also problematic in that, when breaking the bottom of the second container, and when removing the second container from the first container, drops of liquid are scattered, and in particular, there is a risk of infection in the case where the sample contains bacteria, a virus, or the like.

It is an object of the present invention to provide a mixing container according to which it is possible to improve workability for when mixing two or more reagents.

In order to achieve the foregoing object, a mixing container according to the present invention is a mixing container for mixing two or more reagents, including: a first container storing two or more reagents; and a second container for mixing the two or more reagents, wherein the first container includes: reagent storage chambers that are respectively provided for the two or more reagents and have openings formed at portions thereof and a sealing member that seals respective openings of the reagent storage chambers, and the second container includes: an opening portion formed so that the first container can be connected thereto; and protruding portions disposed so as to pierce the sealing member when the first container is connected to the opening portion.

According to the foregoing characteristics, by merely connecting the first container and the second container, the seal of the reagent storage chambers can be broken and the reagents can be mixed easily. With the mixing container according to the present invention, it is possible to improve workability for when mixing two or more reagents.

With the mixing container according to the present invention, it is preferable that in the first container, the reagent storage chambers are formed such that the openings face an identical direction, and in the second container, the opening portion is formed such that the first container can be connected thereto by fitting with the sealing member facing the second container, and the number of the protruding portions is the same as the number of the reagent storage chambers, and the protruding portions are disposed so as to face the respective corresponding storage chambers. In this case, since the seal of the reagent storage chambers can be broken with less force, workability can be improved even further.

Also, with the mixing container according to the present invention, it is preferable that the first container includes a through hole, and the through hole is formed such that an interior and exterior of the second container are in communication when the first container is connected to the second container. In this case, a sample can be easily supplied to the mixing container.

In addition, if the through hole is provided, it is further preferable that the mixing container according to the present invention includes a nozzle that can drip a liquid and is formed to be attachable to the through hole. In this case, dripping of the mixed reagent into which the sample was extracted can be performed easily using the mixing container.

Also, with the mixing container according to the present invention, it is preferable that in the second container, the protruding portions are formed such that portions of the sealing member along edges of the openings of the reagent storage chambers are cut, excluding parts of the portions, when the first container is connected to the opening portion. In this case, the cut pieces of the sealing member can be prevented from falling together with the reagents to the bottom of the second container.

Furthermore, in the above-described case, it is preferable that the protruding portions each include a shearing portion and a pushing portion, the shearing portion is formed so as to protrude more toward the sealing member than the pushing portion does, and the pushing portion is formed at a position closer to a portion of the sealing member that is not to be cut than the shearing portion is. According to this aspect, the cut portions of the sealing member are pushed up to the inner walls of the reagent storage chambers, and come into close contact therewith. As a result, a situation in which the reagents are retained between the cut sealing member and the inner walls of the reagent storage chambers is avoided, and it is easy to reliably and accurately mix the reagents.

With the mixing container according to the present invention, it is possible to improve workability for when mixing two or more reagents.

The foregoing and other objects, features, aspects and advantages of the present invention will become more apparent from the following detailed description of the present invention when taken in conjunction with the accompanying drawings.

DETAILED DESCRIPTION OF THE INVENTION

Embodiment

Hereinafter, a mixing container according to an embodiment of the present invention will be described with reference to FIGS. 1 to 4.

Configuration

Figure 1:
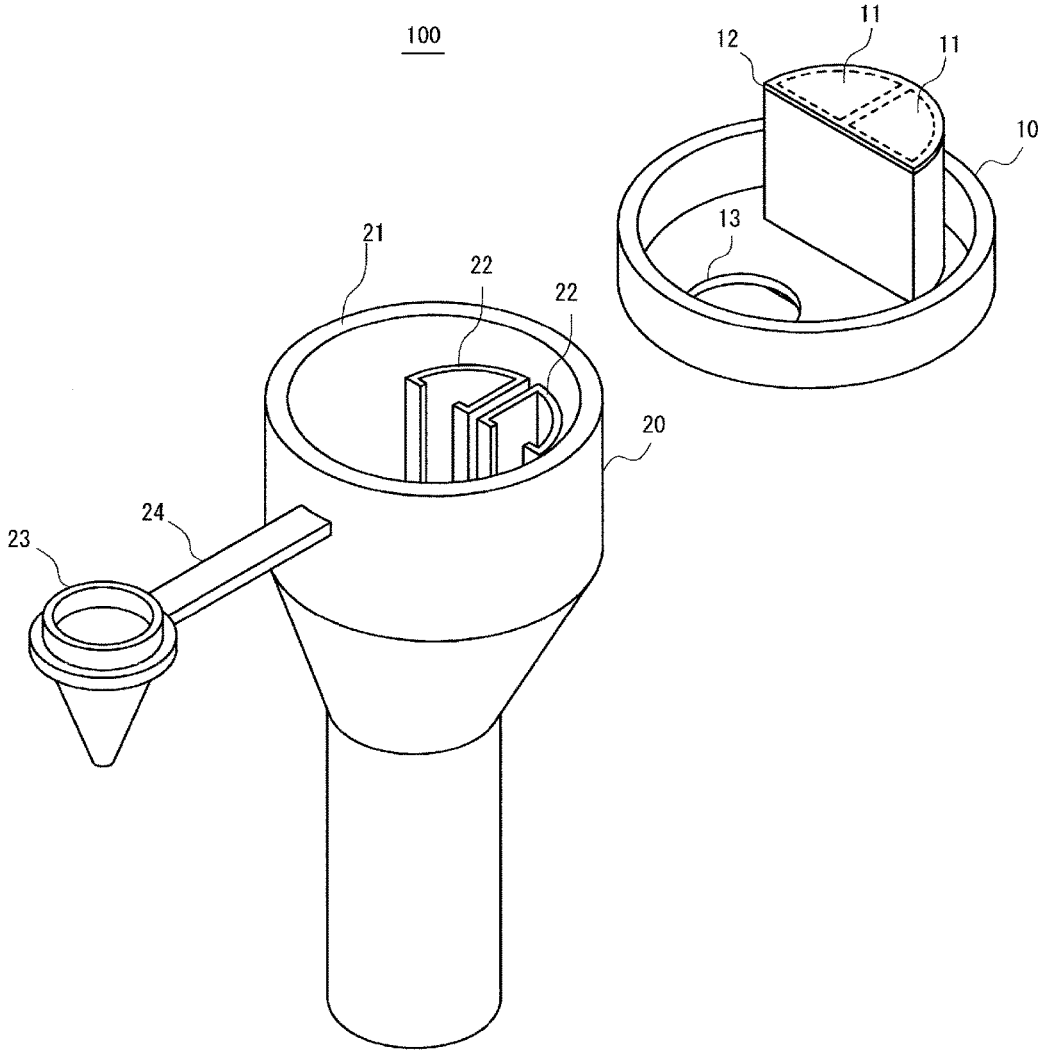
FIG. 1 is an exploded perspective view showing a configuration of a mixing container according to an embodiment of the present invention.
Figure 2:
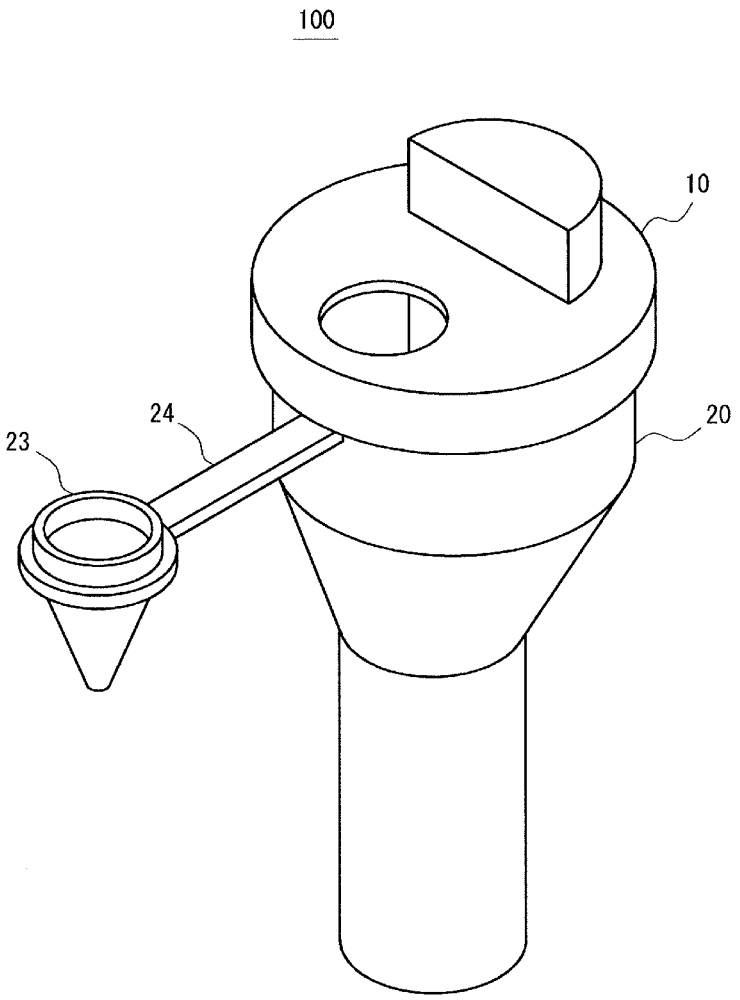
FIG. 2 is a perspective view showing a state in which the mixing container shown in FIG. 1 has been assembled.
Figure 3:
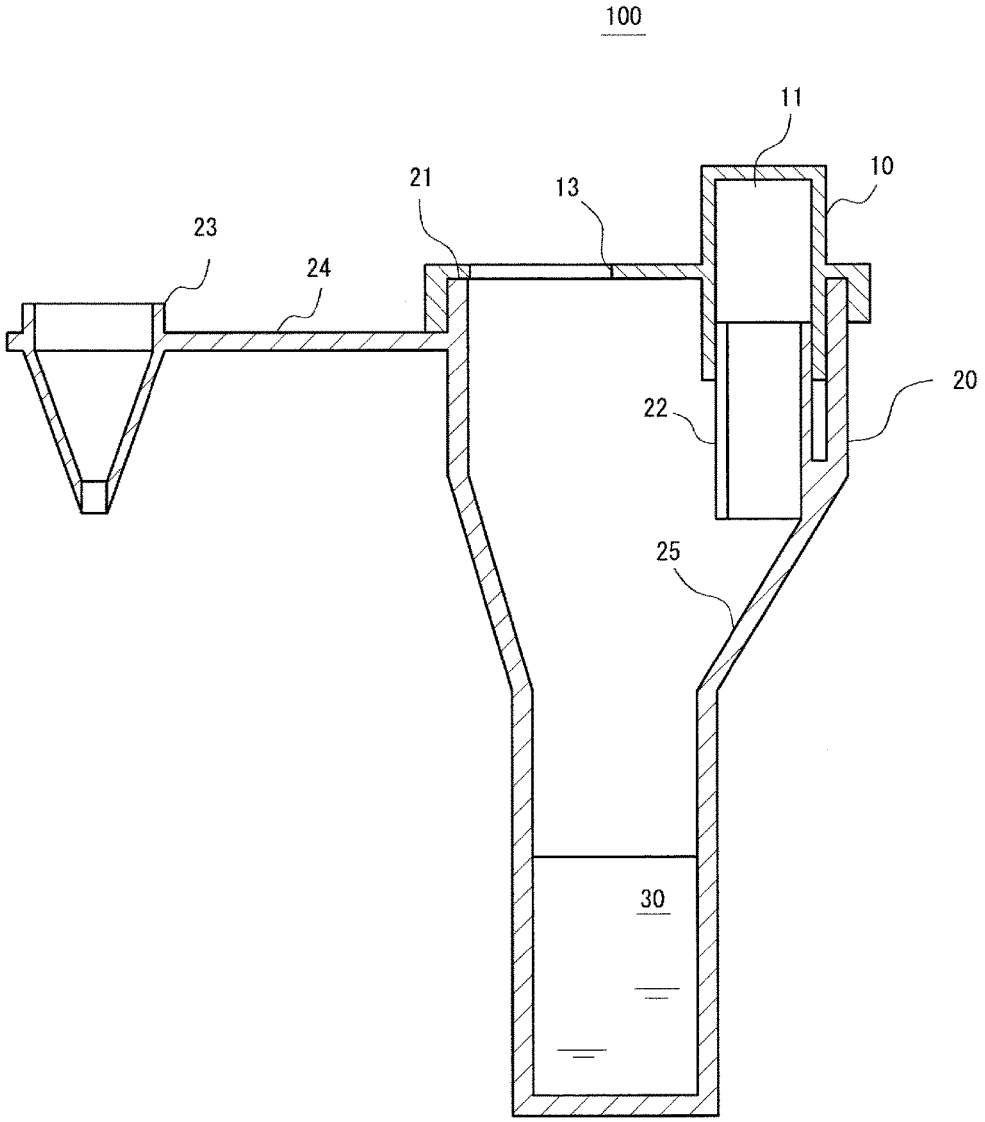
FIG. 3 is a cross-sectional view of the mixing container shown in FIG. 1.

First, a configuration of a mixing container according to the present embodiment will be described with reference to FIGS. 1 to 3. FIG. 1 is an exploded perspective view showing a configuration of a mixing container according to an embodiment of the present invention. FIG. 2 is a perspective view showing a state in which the mixing container shown in FIG. 1 has been assembled. FIG. 3 is a cross-sectional view of the mixing container shown in FIG. 1.

A mixing container 100 according to the present embodiment, which is shown in FIG. 1, is used for mixing two or more reagents. As shown in FIG. 1, the mixing container 100 includes a first container 10 and a second container 20.

The first container 10 is a container that stores two or more reagents, and includes reagent storage chambers 11 respectively provided for the reagents, and a sealing member 12. Also, the reagent storage chambers 11 are formed so as to have openings formed at portions thereof. In FIG. 1, the openings of the reagent storage chambers 11 are indicated by broken lines. The sealing member 12 seals the respective openings of the reagent storage chambers 11. Also, the sealing member 12 is formed of paper, resin film, metallic foil, or the like.

Also, in the present embodiment, in order to make it so that every seal of the reagent storage chambers 11 can be broken at once, the reagent storage chambers 11 are formed such that the openings face an identical direction. Also, in this case, it is possible to use a member that can seal all of the reagent storage chambers 11 collectively as the sealing member 12. Furthermore, in the example shown in FIGS. 1 and 2, since the mixing container 100 is used for mixing two reagents, the number of reagent storage chambers 11 is also two. However, in the present embodiment, there is no particular limitation to these numbers. In the present embodiment, it is sufficient that the number of reagent storage chambers 11 is two or more.

Also, the second container 20 is a container for mixing two or more reagents, and includes an opening portion 21 that is formed so that the first container 10 can connect thereto, and protruding portions 22. Among these, the opening portion 21 is formed so as to be able to connect with the first container 10. In the present embodiment, the opening portion 21 and the first container 10 are connected by fitting the first container 10 onto the opening portion 21 with the sealing member 12 facing the second container 20.

Also, the protruding portions 22 are disposed so as to pierce the sealing member 12 of the first container 10 when the first container 10 is connected to the opening portion 21. In the present embodiment, the number of the protruding portions 22 is the same as the number of the reagent storage chambers 11, and the protruding portions 22 are disposed so as to face the respective corresponding reagent storage chambers 11.

Accordingly, as shown in FIGS. 2 and 3, by merely connecting the first container 10 and the second container 20 with the sealing member 12 facing the opening portion 21 of the second container 20, the sealing member 12 is broken, and the reagents in the reagent storage chambers 11 fall to the bottom of the second container 20, where they are mixed together. Also, in the present embodiment, in order to ensure that the reagents fall, an inclined surface 25 is provided below the protruding portions 22 inside of the second container 20. In FIG. 3, reference numeral 30 indicates reagents that have been mixed (mixed reagent).

Furthermore, in the present embodiment, the protruding portions 22 are formed such that portions of the sealing member 12 along the edges of the openings of the reagent storage chambers 11 are cut, excluding parts of the portions, when the first container 10 is connected to the opening portion 21. This is done to prevent cut pieces of the sealing member 12 from falling together with the reagents to the bottom of the second container 20.

Specifically, in the present embodiment, the openings of the reagent storage chambers 11 each have a quarter-circle shape. Also, in correspondence with this, the cross-sectional shapes of the protruding portions 22 are each formed such that portions of the sealing member 12 located at an arc-shaped portion and one linear portion of each opening are cut, and portions of the sealing member 12 located at the remaining linear portion of each opening are not cut.

Also, as shown in FIGS. 1 to 3, in the present embodiment, the first container 10 includes a through hole 13 for supplying a sample, as will be described later. The through hole 13 is formed such that the interior and exterior of the second container 20 are in communication when the first container 10 is connected to the second container 20.

Furthermore, in the present embodiment, the mixing container 100 includes a nozzle 23. The nozzle 23 is formed so as to be able to drip a liquid and be attachable to the through hole 13 of the first container 10. Also, the nozzle 23 is attached to the second container 20 by a flexible belt-shaped member 24 for the sake of convenience during operation. Specifically, the second container 20, the nozzle 23, and the belt-shaped member 24 are formed integrally by injection molding using a resin material.

Method of Use

Figure 4:
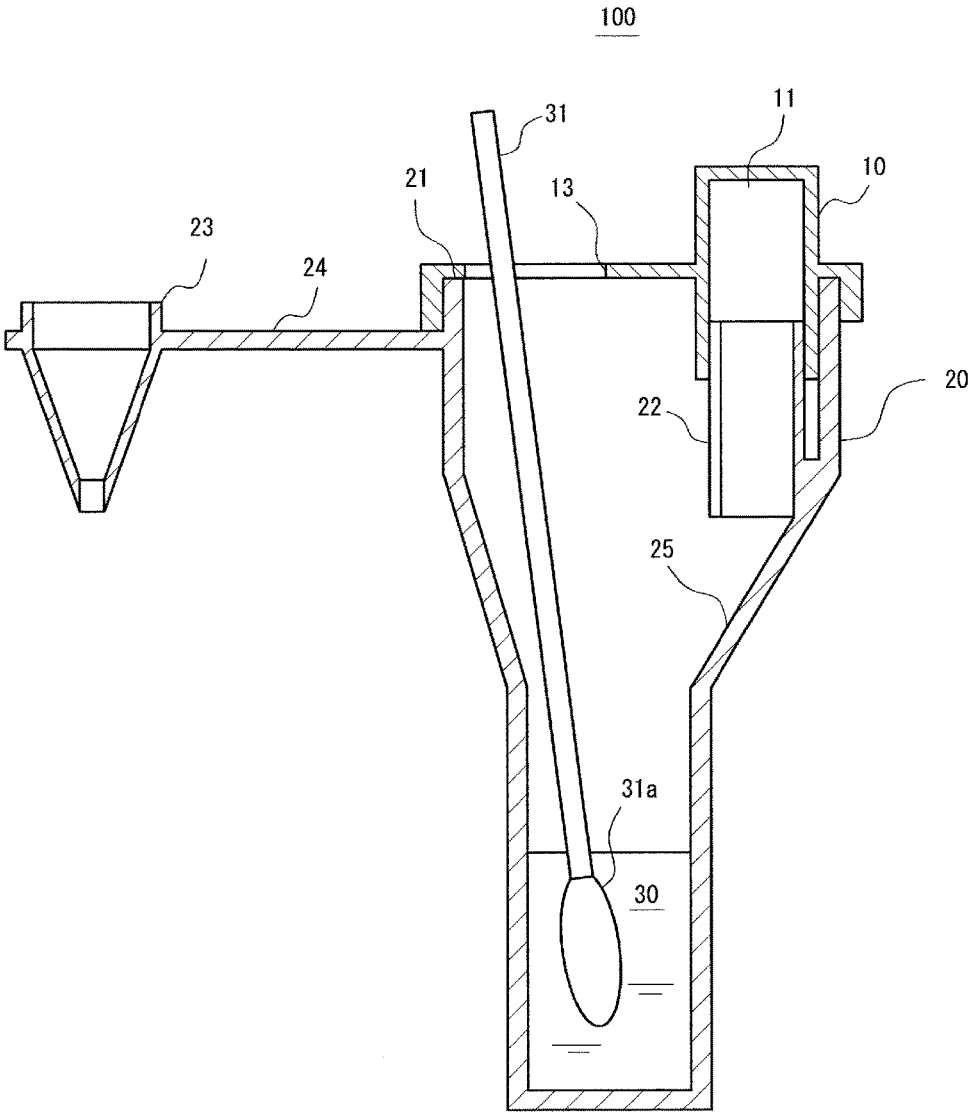
FIG. 4 is a cross-sectional view showing a state of a sample being extracted into reagents that have been mixed in the mixing container.
Figure 5:
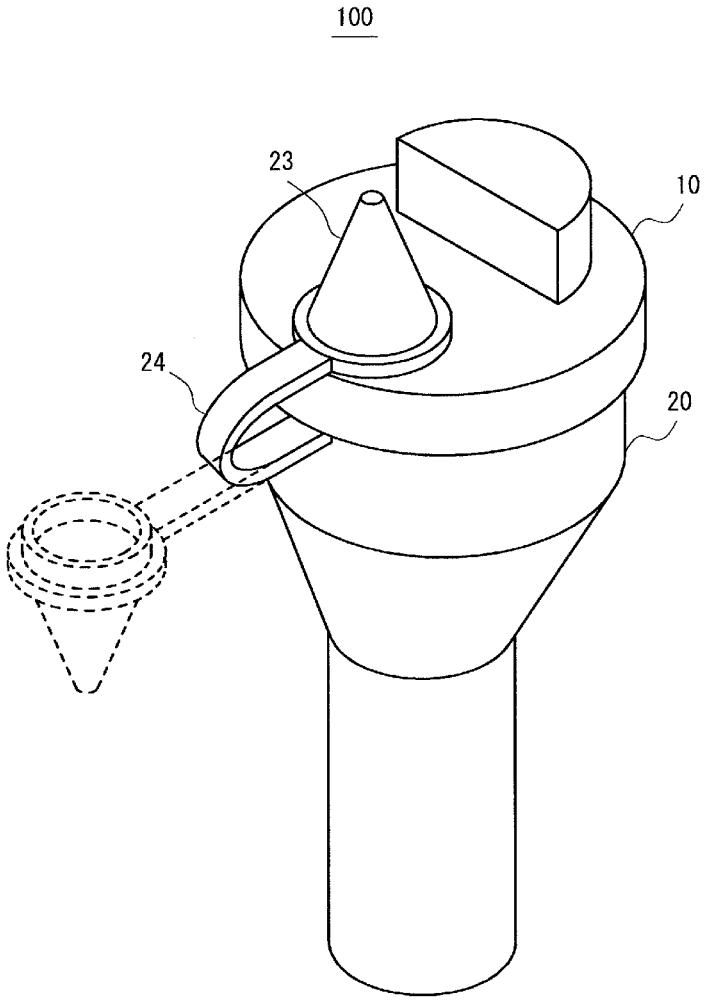
FIG. 5 is a perspective view showing a state in which it is possible to drip the reagent into which a sample was extracted with the mixing container.

Next, a method of using the mixing container 100 will be described with reference to FIGS. 4 and 5. FIG. 4 is a cross-sectional view showing a state of extracting a sample into reagents that have been mixed in the mixing container. FIG. 5 is a perspective view showing a state in which it is possible to drip the reagent into which a sample was extracted with the mixing container.

First, as shown in FIGS. 2 and 3, when the user fits the first container 10 onto the opening portion 21 of the second container 20 so as to connect them, the sealing member 12 that seals the two reagent storage chambers 11 is broken. Accordingly the reagents fall to the bottom of the second container 20. Then, the user mixes the two reagents by shaking the mixing container 100 or the like.

Next, as shown in FIG. 4, the user inserts a cotton swab 31 into the mixing container 100 through the through hole 13 and immerses a leading end portion 31*a* on which a sample has been collected in the mixed reagent 30. According to this, a sample is extracted into the mixed reagent 30. Note that in the example shown in FIG. 4, the sample is supplied using a cotton swab 31, but the present embodiment is not limited to this example. The sample may be supplied directly through the through hole 13, for example.

Next, the user takes the cotton swab 31 out through the through hole 13 and fits the nozzle 23 into the through hole 13. According to this, the mixing container 100 enters the state shown in FIG. 5. Thereafter, depending on the kind of test or the like of the sample, the user can drip the mixed reagent 30 into which the sample was extracted onto a test plate, test paper, or the like from the leading end of the nozzle 23.

Also, in the present embodiment, there is no particular limitation on the sample, and examples thereof include bodily fluids such as pharyngeal mucus, nasal cavity mucus, and blood. Furthermore, although a liquid reagent is used in the example shown in FIGS. 3 and 4, the present embodiment is not limited thereto, and a powder or capsule reagent may be used, for example.

Effects of Embodiment

As described above, with the mixing container 100 according to the present embodiment, reagents can be mixed by merely fitting the first container 10 and the second container 20 together. That is to say, there is no need to rotate the container as with the prior technology, and the user can easily mix reagents while wearing gloves. For this reason, with the mixing container 100, it is possible to improve workability for when mixing two or more reagents.

Also, the reagents are sealed in the first container 10 by the sealing member 12 from the time of manufacturing at a factory to the time of use. For this reason, with the mixing container 100, it is possible to suppress degradation in the quality of the reagents.

Variation

Figure 6:
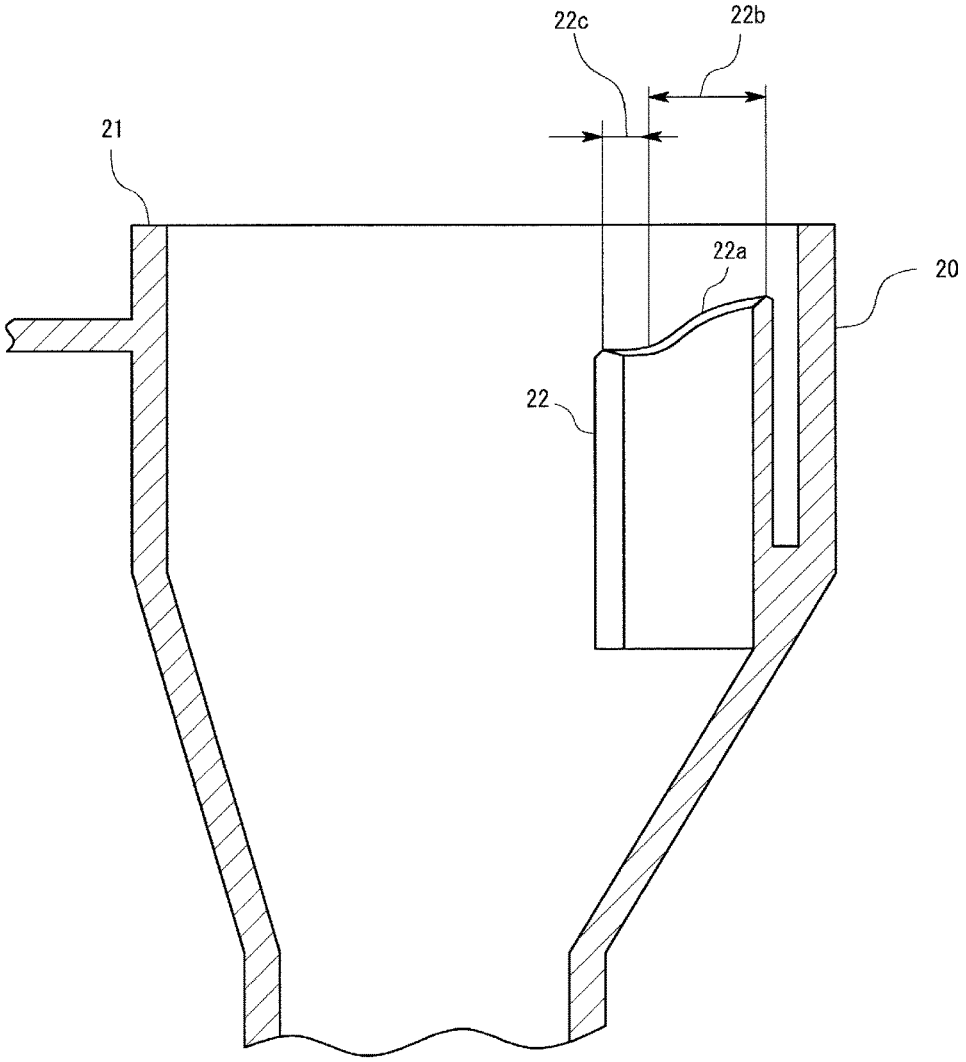
FIG. 6 is a cross-sectional view showing another example of a mixing container according to an embodiment of the present invention.

Next, another example of a mixing container according to the present embodiment will be described with reference to FIG. 6. FIG. 6 is a cross-sectional view showing another example of a mixing container according to an embodiment of the present invention. Note that in FIG. 6, only the portion near the opening portion 21 of the second container 20 is shown enlarged.

As shown in FIG. 6, in the present example, first, the shape of portions 22*a* on the opening side of the protruding portions 22 is a pointed shape. This is done so that the shearing force applied by the protruding portions 22 can be increased and the sealing member 12 (see FIG. 1) can be cut with less force. Also, by using this kind of shape, it is possible to further improve workability.

In addition, in the present example, the protruding portions 22 each include a shearing portion 22*b* and a pushing portion 22*c*. Among these, the shearing portion 22*b* is formed so as to protrude more toward the sealing member 12 than the pushing portion 22*c* does. Also, the pushing portion 22*c* is formed at a location that is closer to the portion of the sealing member 12 that is not to be cut than the shearing portion 22*b* is. In other words, the shearing portion 22*b* is formed so as to be inclined with respect to the normal line of the sealing member 12. On the other hand, the pushing portion 22*c* is formed parallel to the surface of the sealing member 12, and has a roughly flat shape For this reason, in the present example, when the first container 10 and the second container 20 are connected, the protruding portions 22 first come into contact with and cut the portions of the sealing member 12 located at the openings (see FIG. 1) of the reagent storage chambers 11 with the shearing portions 22*b*. Next, when the cutting advances, with the pushing portions 22*c*, the protruding portions 22 can push the cut portions of the sealing member 12 up to the inner walls of the reagent storage chambers 11, causing the cut portions to come into close contact therewith. As a result, a situation in which the reagents are retained between the cut sealing member 12 and the inner walls of the reagent storage chambers 11 is avoided. That is to say, with the present example, such a situation is avoided, and therefore the reagents can be mixed reliably and accurately.

As described above, with the mixing container according to the present invention, it is possible to improve workability for when mixing two or more reagents. The mixing container according to the present invention is effective for use in a field in which mixing of two or more reagents is required, for example, testing of a bodily fluid collected from a human body, or the like.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A mixing container for mixing two or more reagents, comprising:

a first container storing two or more reagents; and a second container for mixing the two or more reagents, wherein the first container includes:

reagent storage chambers that are respectively provided for the two or more reagents and have openings formed at portions thereof, the reagent storage chambers extending from a bottom surface of the first container and beyond a side portion of the first container; and a sealing member that seals respective openings of the reagent storage chambers, and the second container includes:

an opening portion formed so that the first container can be connected thereto; and protruding portions disposed so as to pierce the sealing member when the first container is connected to the opening portion, the protruding portions being positioned below an upper surface of the second container and being aligned within the second container, wherein, the protruding portions provided with a plurality of first edges are formed to continue along a plurality of second edges of the openings of the reagent storage chambers, and the protruding portions are sized to fit inside the reagent storage chambers, while a cut part of the protruding portions is formed to be cut along the second edges of the openings of the reagent storage chambers, such that a substantial portion of the perimeter of the sealing member along the second edges of the openings of the reagent storage chambers are cut, while a part of the portions of the sealing member are not cut by the protruding portions, when the first container is connected to the opening portion of the second container.

2. The mixing container according to claim 1, wherein in the first container, the reagent storage chambers are formed such that the openings face an identical direction, and in the second container, the opening portion is formed such that the first container can be connected thereto by fitting with the sealing member facing the second container, and the number of the protruding portions is the same as the number of the reagent storage chambers, and the protruding portions are disposed so as to face the respective corresponding storage chambers.

3. The mixing container according to claim 1, wherein the first container includes a through hole, and the through hole is formed such that an interior and exterior of the second container are in communication when the first container is connected to the second container.

4. The mixing container according to claim 3, comprising a nozzle that can drip a liquid and is formed to be attachable to the through hole.

5. The mixing container according to claim 1, wherein the protruding portions each include a shearing portion and a pushing portion, the shearing portion is formed so as to protrude more toward the sealing member than the pushing portion does, and the pushing portion is formed at a position closer to a portion of the sealing member that is not to be cut than the shearing portion is.

6. The mixing container according to claim 3, wherein an inclined surface is provided below the protruding portions inside of the second container.

* * * * *